United States Patent [19]

Hillis et al.

[11] Patent Number: 4,773,930

[45] Date of Patent: Sep. 27, 1988

[54] METHOD FOR REMOVING IRON CONTAMINATION FROM MAGNESIUM

[75] Inventors: James E. Hillis, Angleton; William G. Green, Freeport, both of Tex.

[73] Assignee: The Dow Chemical Company, Midland, Mich.

[21] Appl. No.: 873,905

[22] Filed: Jun. 13, 1986

[51] Int. Cl.[4] ..... C22B 26/22

[52] U.S. Cl. ..... 75/63; 75/67 A; 75/93 R; 75/93 AB

[58] Field of Search ..... 75/67 A, 67 R, 63, 93 AB, 75/93 R

[56] References Cited

U.S. PATENT DOCUMENTS 2,384,835 9/1945 Hanawalt et al. ..... 75/67 A 4,417,920 11/1983 Mena et al. ..... 75/67 A

FOREIGN PATENT DOCUMENTS 416403 7/1974 U.S.S.R. ..... 75/67 A

*Primary Examiner*—Melvyn J. Andrews

[57] ABSTRACT

A process for removing iron contamination from molten magnesium by adding to the molten magnesium a mixture of a boron-containing compound and a flux. The boron-containing compound includes, for example, elemental boron, boric acid, and boron oxide. The flux is a conventional magnesium flux. The flux and boron-containing compound mixture is prepared by any suitable means and then added to the molten magnesium at melt temperatures of from about 650° C. to about 700° C. The iron contamination in the magnesium product can be reduced for example from about 400 ppm to less than about 10 ppm.

15 Claims, 1 Drawing Sheet

METHOD FOR REMOVING IRON CONTAMINATION FROM MAGNESIUM

BACKGROUND OF THE INVENTION

This invention relates to a process for removing iron present as an impurity in molten magnesium. More specifically, the invention relates to a process for reducing the iron contamination in molten magnesium by treating the molten magnesium with a mixture of a boron-containing compound and a flux.

Industrial quantities of magnesium containing low levels of metallic contamination such as iron is highly desirable especially for example, in the pharmaceutical industry where magnesium containing less than about 50 ppm is required for some applications.

Heretofore, $BCl_3$ has been used to remove metallic impurities such as iron, silicon and manganese from a liquid magnesium by injecting the $BCl_3$ in the liquid magnesium. However, this process suffers from the disadvantage that a $BCl_3$ vapor forms during the process which readily hydrolyzes in air to form HCl acid and an oxide or a hydroxide, therefore, requiring elaborate equipment to contain and carefully meter the reagent to prevent contamination of the foundry atmosphere with acrid smoke. In addition, because of the reactive nature of $BCl_3$, it must be added slowly to the melt making the overall process slow. Also, $BCl_3$ is a relatively expensive reagent.

It is desired to provide a novel process, without the problems described above, for effectively reducing metallic impurities such as iron contamination in magnesium. It is further desired to provide a relatively less expensive and simplified process for reducing iron contamination in magnesium using more readily available and easily handled raw materials.

SUMMARY OF THE INVENTION

The present invention is directed to a process for reducing metallic impurities such as iron from liquid magnesium. The process involves contacting the liquid magnesium, by a suitable means, with a mixture of a flux and a boron-containing compound.

DETAILED DESCRIPTION OF THE PREFERRED EMBODIMENTS

Figure 1:
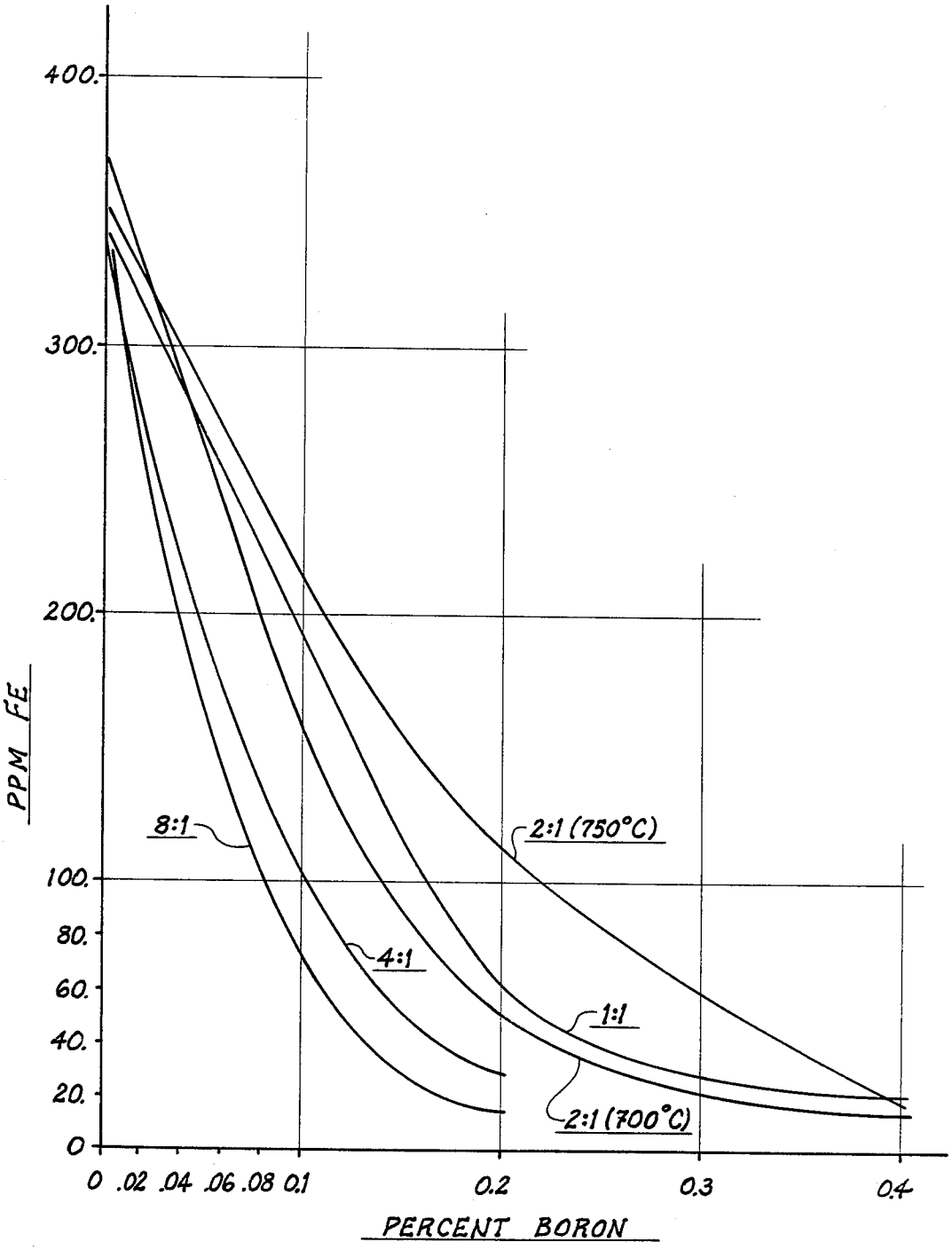
FIG. 1 is a graphical illustration of the reduction of iron (ppm Fe) as a function of percent boron added to the magnesium melt at various ratios of boric acid in magnesium cover flux.

Generally, metallic magnesium is produced by electrolysis of molten magnesium chloride or thermal reduction of the oxide. A description of the processes for producing magnesium is provided in Kirk-Othmer *Encyclopedia of Chemical Technology,* Third Edition, Volume 14, John Wiley & Sons, Inc., New York, (1981), pages 570–615. Typically, commercial primary magnesium contains from 300 ppm to 400 ppm iron contamination. For specific applications, a purer primary magnesium may be desirable. Surprisingly, using the process of the present invention the iron contamination of primary magnesium can be reduced to less than about 5 ppm.

According to the present invention, the iron contamination in a liquid magnesium can be substantially reduced by treating the molten magnesium with material comprising a mixture of a boron-containing compound and flux. Generally, the boron-containing compound and flux mixture is prepared prior to adding the mixture to the molten magnesium, but may be prepared in situ by separately and substantially simultaneously contacting the molten magnesium with the boron-containing compound and flux materials.

Any boron-containing compound other than a fully halogenated boron derivative may be used to form the mixture. "Fully halogenated boron derivative" means $BCl_3$, $BF_3$ and alkali metals or alkali earth metal or magnesium fluoroborates. The boron-containing compound of the present invention includes elemental boron or any boron derivative which effectively reduces the iron content in magnesium in accordance with the present invention. Preferrably, an oxide of boron or a boron-containing compound which forms an oxide of boron upon heating is used in the present invention. The oxide of boron may be selected from the group consisting of boric acid ($H_3BO_3$), boron oxide ($B_2O_3$) and mixtures thereof. It is known that $H_3BO_3$ dehydrates to form $B_2O_3$ when heated, for example, to above about 236° C. Thus, the boron-containing compounds used in the present invention includes any intermediates formed during thermal decomposition of boric acid to boric oxide such as $HBO_2$. Other boron-containing compounds which may be used for producing the mixture include borax ($Na_2B_4O_7$) and other oxyborates.

Of the boron derivatives used in the present invention, $H_3BO_3$ provides optimum reduction of iron contamination from magnesium melt, but $B_2O_3$ may be used because it is readily available and does not require pretreatment prior to its use.

The flux used for forming the mixture of the present invention may be selected from any conventional magnesium flux used for preventing oxidation of the melt and/or refining the melt. Halogenated fluxes, including alkali earth metal and alkali metal halide salts and mixtures of these salts are generally used as fluxes. For example, the flux compositions described in Table I below, designated as type M-230 and M-130, are commercially available fluxes manufactured by SRC Inc. of Cleveland, Ohio.

TABLE I

| | Flux Compositions | |
|---|---|---|
| | Flux M-230 | Flux M-130 |
| KCl | 43% | 55% |
| $BaCl_2$ | 8–11% | — |
| $CaF_2$ | 2–5% | 5% |
| $MgCl_2$ | 31–37% | 40% |
| MgO | 4% max | — |

Preferably, the flux used in the present invention is of the type M-130 because the flux contains no $BaCl_2$. $BaCl_2$ may pose an environmental problem and under current government regulation can not be emitted into the environment.

Other compounds can be mixed in with the flux and boron-containing compound in amounts which will not interfere with the reduction of iron contamination from the magnesium. For example, fluorspar ($CaF_2$) used for removing suspended oxide and flux contamination.

The amount of boron-containing compound and flux added to the molten magnesium depends on the melt temperature and the reduction in iron content desired. For example, at about 700° C. an addition of about 0.68% boron oxide (about 0.2% boron) or an equivalent amount of boric acid (about 1.2% boric acid) combined with about 1.2% to about 2.4% 130 flux, based on the melt weight, is sufficient to reduce the iron content by about 80% or more. Higher levels of flux result in greater reductions in the iron content for a given amount of boron oxide or its boric acid equivalent. For example, at about 700° C. using the same amount of boron oxide (about 0.68%) combined with twice the amount of flux, i.e. from about 4.8 to about 9.6%, reduces the iron content by about 90% or more.

The residual iron level following treatment is also directly related to the metal temperature. Thus, at about 750° C. an addition of about 0.68% boron oxide (about 1.2% boric acid) combined with about 2.4% 130 flux results in a reduction of iron by about 65% or more, while the same addition at about 700° C. results in a reduction of iron content by about 85% or more.

The temperature of the molten magnesium should be from about 650° C. to about 780° C. The preferred temperature for the process is in the range of about 660° C. to about 710° C. The preferred boron oxide (or boric acid equivalent) and flux additions are in the range of about 0.68% to about 1.0% and about 1.2% to about 7.3%, respectively.

In carrying out the process of the present invention the flux is combined with the boron-containing compound, by any suitable means, and then added as a mixture to the molten magnesium. In another embodiment, the flux and the boron-containing compound are added to the molten magnesium separately and substantally simultaneously such that the compounds react in situ with each other and the metallic impurities. Yet, in another embodiment of the process the individual salts which make up the flux can be treated with the boron-containing compound and then subsequently mixed together to form the mixture for reducing iron contamination in molten magnesium.

The preferred method of the present invention is to contact and mix the flux and boron-containing compound together prior to adding the mixture to the molten magnesium. The mixture is preferably, heated to a temperature of from about 200° C. to about 400° C. to dry and intimately combine the compounds. Optionally, after heating, the resultant mixture, the mixture may be ground to increase its surface area and facilitates its addition to the melt. The size of the ground mixture can be golfball-size granules or particles in a fine powder form. The mixture is then ready to be added to the liquid magnesium.

In one embodiment of the present process, $B_2O_3$ may be combined directly with flux to form the mixture. When using, for example $H_3BO_3$, the $H_3BO_3$ can be dehydrated to $B_2O_3$ and then the $B_2O_3$ can be mixed with flux to form a mixture suitable for reducing iron contamination in magnesium. In another embodiment, $H_3BO_3$ is combined with flux and the combination heated to above about 236° C. to form the mixture.

The method and apparatus used for contacting the boron-containing compound and flux mixture with the molten magnesium can be any method and apparatus known in the art. For example, an open cast iron, gas-fired crucible may be used to melt the magnesium.

The magnesium produced by the present invention is a "high purity" magnesium containing less than about 100 ppm iron and, more preferably, less than about 50 ppm iron. Magnesium with as low as about 5 ppm iron content has been produced in the method of the present invention. The low iron content magnesium can be used in various applications depending on the amount of iron impurity tolerated in such applications. For example, in the pharmaceutical industry, the magnesium used may be required to have less than about 100 ppm iron content. In the aerospace industry, the magnesium used may be required to have less than 50 ppm iron content. In other applications, for example, in photoengraving sheet production and high performance anode production, a magnesium with an iron content of less than 50 ppm can be useful. In still other applications such as the reduction of metals, for example, Ti and Zr, magnesium with less than about 100 ppm is useful.

The following examples are illustrative of the present invention but are not to limit the invention.

EXAMPLE 1

A 2:1 flux to $H_3BO_3$ mixture was prepared by mixing 2 parts of 130 flux (SRC, Inc.) to 1 part of $H_3BO_3$. The mixture was heated to 400° C. to drive off any moisture, cooled to ambient temperature (~25° C.), ground to granular form, and stored in moisture proof plastic bottles.

To a 50 pound (lbs) batch of molten primary magnesium, 0.8 lbs of the 2:1 flux to $H_3BO_3$ mixture (i.e. 2 parts 130 flux to 1 part $H_3BO_3$) was added and mixed for 10 minutes. The 0.8 lbs flux mixture corresponds to a 0.1% boron level in the melt. After the mixer was turned off, the melt was left to settle for 10 minutes and samples were then taken. The mixer was then started again and another 0.8 lbs 2:1 flux mixture was added to the melt and mixed for 10 minutes. The melt was then left to settle for another 10 minutes and samples were then taken. Then 1.6 lbs of the 2:1 flux mixture (0.2% boron for a 0.4% total boron content) was added to the melt and mixed for 10 minutes. After 10 minutes of mixing the mixer was stopped and the melt was left to settle before sampling. The temperature of the melt was maintained at about 700° C.

| | Results | |
|---|---|---|
| Sample | B content | Fe content |
| untreated melt | 0.47 ppm | 370 ppm |
| 0.1% boron level | 0.88 ppm | 150 ppm |
| 0.2% boron level | 1.4 ppm | 49 ppm |
| 0.4% boron level | 3.8 ppm | 12 ppm |

EXAMPLE 2

The same procedure in Example 1 was repeated except that the temperature of the melt was maintained at 750° C.

| | Results | |
|---|---|---|
| Sample | B content | Fe content |
| Untreated melt | 0.15 ppm | 350 ppm |
| 0.1% boron level | 0 | 210 ppm |
| 0.2% boron level | 0.29 ppm | 110 ppm |
| 0.4% boron level | 1.3 ppm | 17 ppm |

EXAMPLE 3-5

The same procedure in Example 1 was repeated except that the flux to $H_3BO_3$ ratios used were as follows:

1:1=1 part 130 flux to 1 part $H_3BO_3$

4:1=4 parts 130 flux to 1 part $H_3BO_3$

8:1 = 8 parts 130 flux to 1 part $H_3BO_3$

The temperature was maintained at 700° C. for these examples. The results of Examples 1-5 are shown graphically in FIG. 1.

EXAMPLE 6

This example was carried out to demonstrate a different technique for manufacturing the flux/$H_3BO_3$ mixture. A 5.0 lbs. sample of $H_3BO_3$ was heated to 400° C. and held at that temperature for 3 hours. The resultant oxide of boron was then allowed to cool to ambient temperature (~25° C.) before grinding into granular form. The oxide was then mixed with 5.0 lbs of 130 flux to make flux/oxide mixture equivalent to a 1:1 flux to $H_3BO_3$ mixture. The mixture was then added to a 50 lb melt of primary magnesium in increments as described in Example 1. The temperature was maintained at 700° C.

| | Results | |
|---|---|---|
| Sample | B content | Fe content |
| Untreated melt | 2.5 ppm | 350 ppm |
| 0.1% boron level | 2.7 ppm | 250 ppm |
| 0.2% boron level | 0 ppm | 120 ppm |
| 0.4% boron level | 0.46 ppm | 41 ppm |

What is claimed is:

1. A process for reducing metallic impurities in a magnesium melt comprising adding to the melt a mixture of a flux and an oxide of boron sufficient to reduce the metallic impurities in the melt.

2. The process of claim 1 wherein the metallic impurity is iron.

3. The process of claim 1 wherein the iron impurity of the melt is reduced to less than about 100 ppm.

4. The process of claim 3 wherein the iron impurity of the melt is reduced to less than about 50 ppm.

5. The process of claim 1 wherein the ratio of flux to the oxide of boron is from about 8:1 to about 1:1.

6. The process of claim 1 wherein the oxide of boron is selected from the group consisting of boron oxide, boric acid and mixtures thereof.

7. The process of claim 1 wherein the oxide of boron is boric acid.

8. The process of claim 1 wherein the oxide of boron is boron oxide.

9. A process for reducing metallic impurities in a magnesium melt comprising adding to the melt a mixture of a flux and elemental boron.

10. The process of claim 1 wherein the oxide of boron is a borate.

11. The process of claim 1 wherein the flux is a magnesium melt cover or refining flux.

12. The process of claim 1 wherein the flux is a halogenated flux.

13. The process of claim 1 wherein the flux is selected from the group consisting of KCl, $BaCl_2$, $CaF_2$, $MgCl_2$, MgO and mixtures thereof.

14. The process of claim 1 wherein the temperature of the magnesium melt is from about 650° C. to about 780° C.

15. The process of claim 14 wherein the temperature of the magnesium melt is from about 660° C. to about 710° C.

* * * * *